US009241577B1

(12) United States Patent
Shea

(10) Patent No.: US 9,241,577 B1
(45) Date of Patent: Jan. 26, 2016

(54) MATTRESS CORNER LIFTING DEVICE

(71) Applicant: Jeffery Allen Shea, Snohomish, WA (US)

(72) Inventor: Jeffery Allen Shea, Snohomish, WA (US)

(73) Assignee: THREE60 LLC, Snohomish, WA (US)

( * ) Notice: Subject to any disclaimer, the term of this patent is extended or adjusted under 35 U.S.C. 154(b) by 0 days.

(21) Appl. No.: 14/696,894

(22) Filed: Apr. 27, 2015

(51) Int. Cl.

| | |
|---|---|
| ***A47C 31/00*** | (2006.01) |
| ***B66F 11/00*** | (2006.01) |
| ***A47C 21/02*** | (2006.01) |
| ***B66F 11/04*** | (2006.01) |

(52) U.S. Cl.
CPC ..... *A47C 21/028* (2013.01); *A47C 21/026* (2013.01); *A47C 31/00* (2013.01); *B66F 11/00* (2013.01); *B66F 11/042* (2013.01)

(58) Field of Classification Search
CPC ..... A47C 21/026028; A47C 31/00; A47C 21/026; A47C 21/028; B66F 3/22; B66F 11/00; B66F 11/042; A47B 9/00; A47B 9/02; A47B 9/16; A47B 2200/0041; A47B 2200/0043; A47B 27/08; A47B 17/02
USPC ..... 108/9, 10, 145–147
See application file for complete search history.

(56) References Cited

U.S. PATENT DOCUMENTS

| | | | | | |
|---|---|---|---|---|---|
| 346,246 | A * | 7/1886 | Uhde | 5/611 | |
| 1,866,696 | A * | 7/1932 | Isidor | 5/612 | |
| 2,291,444 | A * | 7/1942 | Bengtson | 5/498 | |
| 2,666,216 | A * | 1/1954 | Schnaitter | 5/660 | |
| 3,259,921 | A * | 7/1966 | Alsobrook, Jr. | 5/610 | |
| 3,277,501 | A * | 10/1966 | Frisz | A47C 20/042 108/145 | |
| 3,921,230 | A * | 11/1975 | Hanning et al. | 5/616 | |
| 3,952,346 | A * | 4/1976 | Carlson | 5/660 | |
| 4,651,365 | A * | 3/1987 | Zeigler | 5/660 | |
| 4,768,242 | A * | 9/1988 | LoTurco | 5/93.1 | |
| 4,989,281 | A * | 2/1991 | Christensen | 5/118 | |
| 5,598,591 | A * | 2/1997 | Kelley | 5/118 | |
| 5,613,255 | A * | 3/1997 | Bish et al. | 5/611 | |
| 5,713,091 | A * | 2/1998 | Houchin | 5/660 | |
| 5,732,425 | A * | 3/1998 | Leung | 5/611 | |
| 5,771,515 | A * | 6/1998 | Carr | 5/660 | |
| 6,629,322 | B1 * | 10/2003 | Monroe | 5/10.2 | |
| 7,146,662 | B1 * | 12/2006 | Pollard et al. | 5/617 | |
| 7,398,569 | B2 * | 7/2008 | Sakaldasis et al. | 5/488 | |
| 7,581,270 | B1 * | 9/2009 | Levesque | 5/660 | |
| 7,707,669 | B1 * | 5/2010 | Richardson | 5/660 | |
| 7,730,567 | B2 * | 6/2010 | Jaeger | 5/658 | |
| 7,818,837 | B2 * | 10/2010 | Gonser, Jr. | 5/488 | |

(Continued)

OTHER PUBLICATIONS

Mattress Genie Product Guide, Contour Products, Inc.

*Primary Examiner* — Robert G Santos
*Assistant Examiner* — David R Hare
(74) *Attorney, Agent, or Firm* — Timothy E. Siegel Patent Law, PLLC; Timothy E. Siegel

(57) ABSTRACT

A mattress corner lifter that includes a base and a lifting mechanism supported by the base. Also, a platform is rotatably supported at the top of the lifting mechanism. The lifting has a compressed state, an extended state and an intermediate state between the compressed and extended states. In the compressed state the mattress lifter pushes up with a force of less than 25 lbs, but in its intermediate state the force with which the mattress lifter presses up increases as the mattress lifter extends, until it reaches a maximum of at least 40 lbs, and wherein at the extended state the mattress lifter resists compression with a force of at least 40 lbs.

9 Claims, 3 Drawing Sheets

(56) References Cited

U.S. PATENT DOCUMENTS

| | | | | |
|---|---|---|---|---|
| 7,917,979 | B2 | 4/2011 | Amsler et al. | |
| 8,015,638 | B2 * | 9/2011 | Shimada | A47C 19/04 108/145 |
| 8,191,191 | B2 * | 6/2012 | Montross | 5/660 |
| 2010/0064438 | A1 * | 3/2010 | Knudsen et al. | 5/611 |
| 2012/0023669 | A1 | 2/2012 | Graller et al. | |
| 2013/0232698 | A1 * | 9/2013 | Ward | 5/659 |
| 2013/0291309 | A1 * | 11/2013 | Koorey | 5/658 |

* cited by examiner

MATTRESS CORNER LIFTING DEVICE

BACKGROUND

Those tasked with changing sheets on a bed typically must lift up the corner of a mattress to take out the old fitted sheet and replace it with a new one. This can be difficult, particularly for people who are old or infirm or both. Although some devices have been introduced to ease this task, none has truly filled the human need.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect, the present invention may take the form of a method of lifting up and then pressing down, an end portion of a mattress that is generally supported on a supporting surface. The method utilizes a lifting device having an expanded position that is between 15 cm and 45 cm high, and a compressed position that is up to 6 cm high, and which in the expanded position resists compression sufficiently so that the weight of the mattress does not compress the device, but in the compressed position is urged toward its expanded position by a force small enough so that the weight of the mattress maintains the device in its compressed position and which is urged toward its expanded position by a force that is greater than the weight of the mattress, after the device has been released from the compressed position, but before reaching its extended position, the device being in its compressed state and underneath an end portion of the mattress, and being supported by the supporting surface, before subsequent steps of the method are performed. The mattress end portion is lifted up, thereby reducing the force exerted by the weight of the mattress to a level below the force urging the device toward its expanded position, and thereby permitting the device to expand into its expanded position, so that the device lifts the mattress end portion and supports it in an elevated position. Later, the mattress end portion is pushed down with sufficient force that together with force exerted by the weight of the mattress, the device is compressed into its compressed state.

In a second separate aspect, the present invention may take the form of a bed, having a base, having a rectangular top surface, defining two mattress-wide end portions, each including two interior corners of said base and a mattress having two mattress-wide end portions each including two interior corners of said mattress, supported by the rectangular top surface. Further, a mattress end portion lifter is supported by the base at an end portion, beneath a first mattress end portion. The lifter has a compressed state, in which the lifter exerts an upward force that is less than the weight of the mattress pushing down on the lifter and an intermediate, partially-extended state, in which the lifter exerts an upward force that is greater than the weight of the mattress pushing down on the lifter and further has an extended state, in which the lifter resists compression by a force great enough to resist being compressed by the downward force of the weight of the mattress. Accordingly, a user may release the lifter from its compressed state by lifting up on the first mattress end portion and may place the lifter into its compressed state by pushing down on the first mattress corner.

In a third separate aspect, the present invention may take the form of a mattress corner lifter that includes a base and a lifting mechanism supported by the base. Also, a platform is rotatably supported at the top of the lifting mechanism. The lifting has a compressed state, an extended state and an intermediate state between the compressed and extended states. In the compressed state the mattress lifter pushes up with a force of less than 25 lbs, but in its intermediate state the force with which the mattress lifter presses up increases as the mattress lifter extends, until it reaches a maximum of at least 40 lbs, and wherein at the extended state the mattress lifter resists compression with a force of at least 40 lbs.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Figure 1:
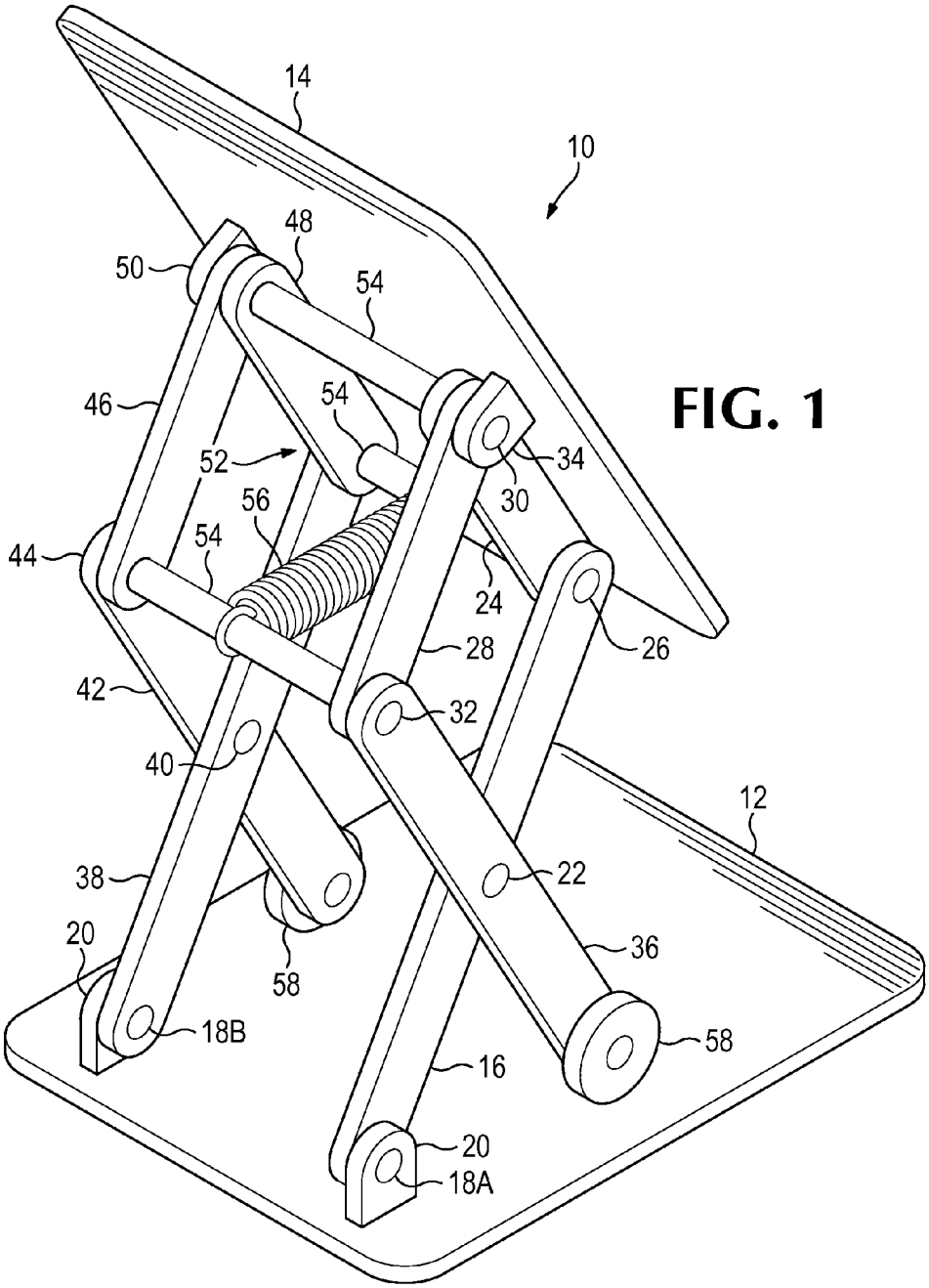
FIG. 1 shows a top-side-front isometric view of a mattress lifting device according to the present invention.

In a preferred embodiment of the invention, as shown in FIG. 1, a lifting device 10 is comprised of a base platform 12, which is joined to a top platform 14 through a series of eight interconnected bars, comprising two parallel sets of four interconnected bars. In the first set, the first end of a first bar 16 is joined to a base platform 12 through a first hinge point 18A mounted on intermediate element 20. A second hinge point 22 is located at the midpoint of a first bar 16, and joins said first bar 16 with a second bar 36, such that the bars may appear to intersect one another at a variety of angles, depending on the expansion or compression of the lifting device 10. The second end of a first bar 16 is hinged to the first end of a third bar 24 at a hinge point 26; likewise, the second end of a second bar 36 is hinged to the first end of a fourth bar 28 at a hinge point 32. The second ends of a third bar 24 and a fourth bar 28 are then hinged together at a hinge point 30. The top platform 14 is rotatably attached to a hinge point 30 by a second intermediate element 34.

In the second set of four interconnected bars, the first end of a fifth bar 38 is joined to a base platform 12 through a first hinge point 18B mounted on intermediate element 20. A second hinge point 40 is located at the midpoint of the fifth bar 38, and joins said fifth bar 38 with a sixth bar 42, such that the bars may appear to intersect one another at a variety of angles, depending on the expansion or compression of the lifting device 10. The second end of a fifth bar 38 is hinged to the first end of a seventh bar 48 at a hinge point 52; likewise, the second end of a sixth bar 42 is hinged to the first end of an eighth bar 46 at a hinge point 44. The second ends of the seventh bar 48 and an eighth bar 46 are then hinged together at a hinge point 50. The platform 14, in addition to being hinged at point 30, as noted above, is rotatably attached to hinge point 50.

Notably, bars 24, 28, 46, and 48 are of identical proportions, and bars 16, 36, 38, and 42 are also of identical proportions, such that device 10 may expand between 15 and 45 centimeters, and compress to 6 centimeters. Cross-members 54 join the hinge points 32 and 44, 26 and 52, and 30 and 50, thus allowing the lifting device 10 to expand and compress. A spring 56 is fastened to a cross-member 54 between hinge points 32 and 44 and a second cross-member 54 between hinge points 26 and 52, and tensions the device 10. The first ends of bars 36 and 42 may feature wheels 58 as shown in FIG. 1, or, alternatively, smooth, blunt ends (not shown) that can slide on base platform 12, allowing a user to expand or compress the device 10 more easily. In another preferred embodiment, the lifting device 10 may include only one set of four interconnected bars. In one embodiment one or more of the bars might have a forked end or forded ends, for greater transverse stability. In another embodiment, the platform 14 may be attached to at a single one of hinge point 34 or 50 with a ball and socket joint, permitting a greater range of pivoting motion, thus permitting the device 10 to adapt to a greater range of mattress configurations.

In this embodiment, the expansion of the spring 56 is positively related to the degree of compression of the device 10. This relationship may be explained mathematically using Equation 1, where k is the stiffness constant of the spring 56, θ is the angle formed between the bar 24 and spring 56, F is the upward force exerted by superior platform 14 (or the force resisting compression, when device 10 is in its extended state), $L_S$ is the length of the compressed spring 56, and $L_B$ is the length of any one of bars 24, 28, 46 or 48 and $F_I$ is the initial resistance against extension of spring 56.

$$(F_I+2k(L_B \cos\theta-0.5L_S))(\sin\theta)=F \qquad \text{Equation 1}$$

Skilled persons will recognize that the upward force F will initially grow as θ is reduced and the spring 56 is stretched, exerting a greater force. But a maximum is reached when the value of sin θ, which decreases with decreasing θ, begins to decrease faster than the spring force is increasing. Put into familiar physical terms, the spring is exerting more force, but a smaller proportion of that force is directed upwardly, as an upward force.

Figure 2:
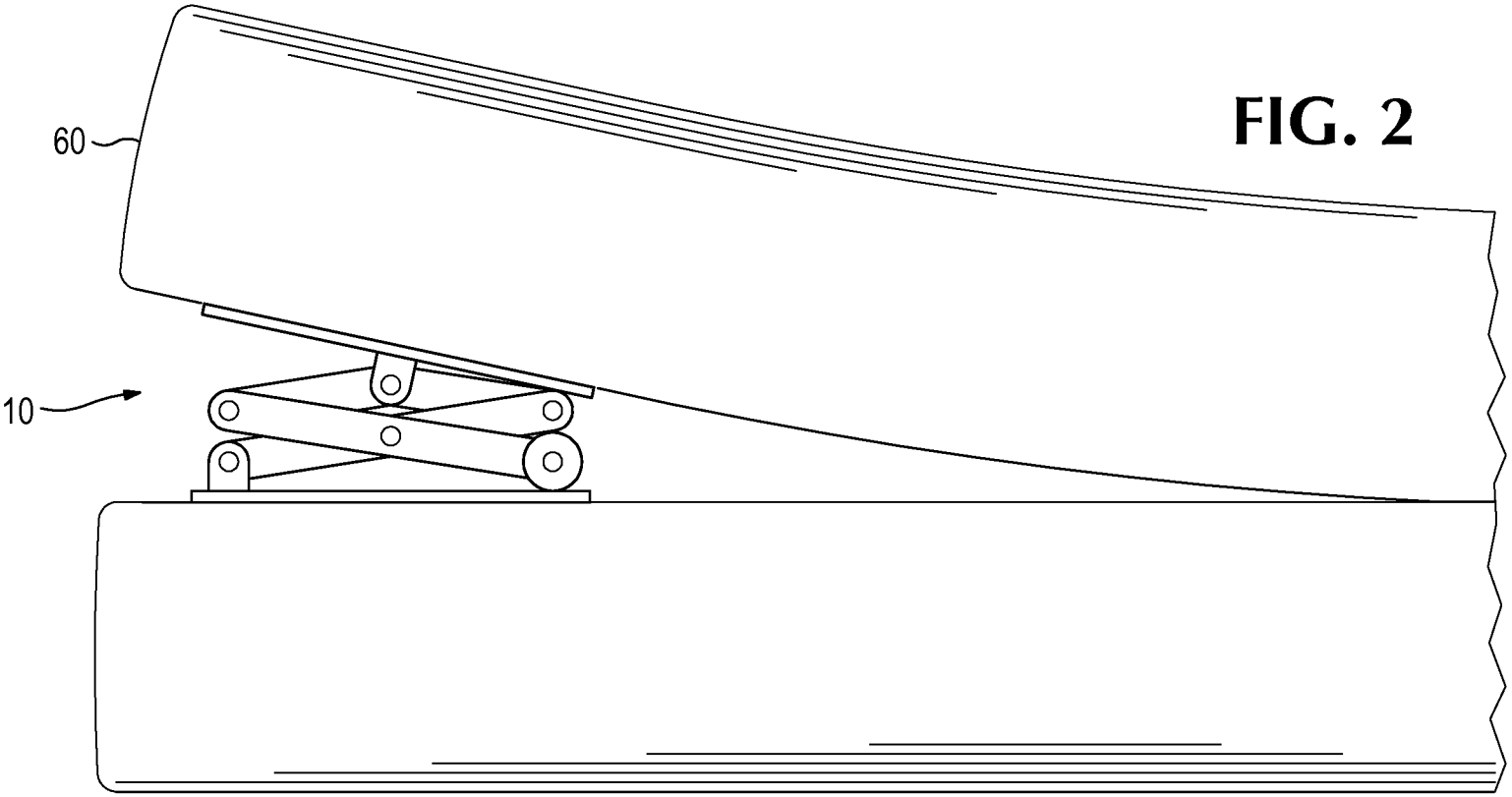
FIG. 2 is a perspective view of the device of FIG. 1 in its compressed state, underneath a mattress corner.
Figure 3:
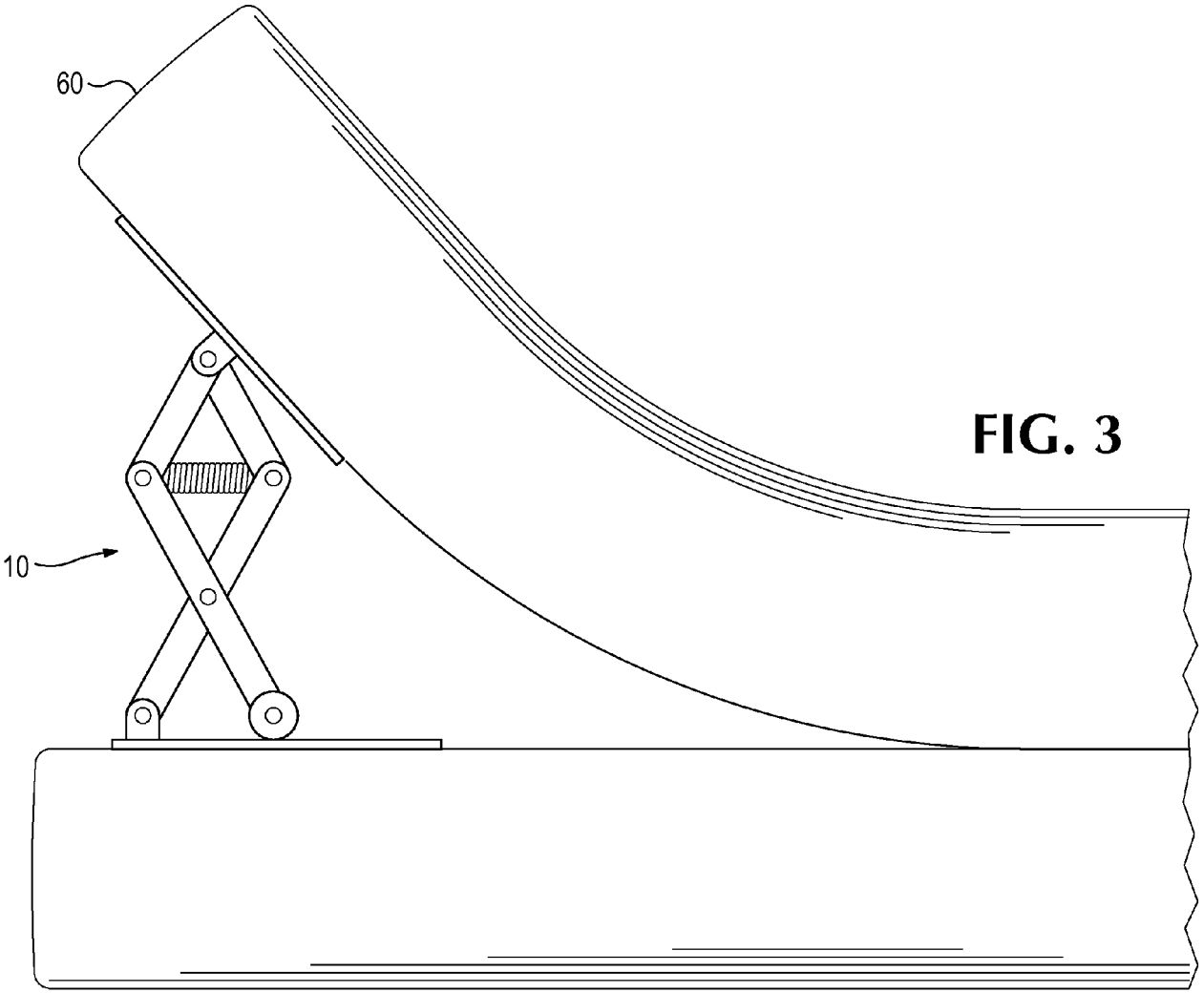
FIG. 3 is a perspective view of the device of FIG. 1 in its extended state, underneath a mattress corner.

The lifting device 10 may lift up an end portion, which could more specifically by a corner, of a mattress that is generally supported on a supporting surface. After the end portion has been lifted, for example to change a fitted sheet, it may be returned to its initial resting position by pressing down upon it, so that the downward force exerted by a user, plus the mattress weight returns device 10 to its compressed position, as shown in FIG. 2. As used in this application, the term "end portion" may refer to a mattress-wide end portion or to a mattress corner. The lifting device 10 may be an integral component of a bed, which may be manufactured such that there is one at each mattress-wide end portion (two in all) or one for each corner (four in all) beneath the mattress. Alternatively a set of lifting devices 10 may be added to an existing bed beneath the mattress. Lifting devices 10, adapted to be added to an existing bed, may have some engagement features on the bottom of base platform 12 or at the top of top platform 14, or both, to engage the surface upon which device 10 rests, and/or engage the mattress 60. Such engagement features could include adhesives, short spikes or a "grippy" rubberized material. Alternatively, device 10 could be affirmatively fastened to the surface upon which it rests.

When a user lifts up on a mattress end portion 60, the downward force exerted by the weight of the mattress is reduced to a level below that of the upward force F exerted by the platform 14. Consequently, the device 10 begins to expand vertically with increasing force for at least a first portion of its expansion, until it reaches its extended state. However, when the user presses down on the mattress end portion 60, the combined downward forces from the user-applied pressure and the weight of the mattress surpass the upward force, thereby urging the device towards its compressed position, causing the spring 56 to expand and the device 10 to compress. FIG. 2 shows the device in its compressed state as a result of these overwhelming downward forces, where it will stay from the mattress weight, as the upward force in the compressed position is much smaller than the upward force in the expanded or intermediate position.

In one preferred embodiment, 62 lbs of force is required to begin to compress device 10, and after achieving its compressed position, 20 lbs of force is required to keep it in that position. Further, in this embodiment top platform 14 measures 18 cm×13 cm (7"×5") and the base platform measures 25 cm×13 cm (10"×5"). Finally, in a preferred embodiment the device expands from a compressed height of 3.8 cm (1.5") to an expanded height of 28 cm (11"). Device 10 may be made of steel. Alternatively, the bars 24, 28, 46, and 48 and bars 16, 36, 38, and 42 may be made of wood, as well as can be platforms 12 and 14. In general, any material having the requisite strength may be used.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A method of lifting up and then pressing down, an end portion of a mattress that is generally supported on a supporting surface, said method comprising:

a) providing a lifting device, including a spring, and having an expanded position that is between 15 cm and 45 cm high, a compressed position that is up to 6 cm high, and an intermediate state, between said compressed and expanded positions, and wherein in said expanded position said spring urges said device to resist compression sufficiently so that the weight of the mattress does not compress said device, but in said compressed position said spring urges said device toward said intermediate state by a positive upward force small enough so that the weight of said mattress maintains said device in its compressed position and when in said intermediate state said spring urges said device toward its expanded position by a force that is greater than the weight of said mattress, said device being in its compressed state and underneath an end portion of said mattress, and being supported by said supporting surface, before subsequent steps of said method are performed;

b) lifting up on said mattress end portion, thereby reducing the force exerted by the weight of said mattress to a level below the force urging said device toward said intermediate state, and thereby permitting said device to expand into said intermediate state, which thereby causes said device to expand into its expanded position, so that said device lifts said mattress end portion and supports it in an elevated position; and c) pressing down said mattress end portion with sufficient force that together with force exerted by the weight of said mattress, said device is compressed into its compressed state.

2. The method of claim 1, wherein said lifting device includes:

a) a base platform;

b) a first bar having a first end and a second end, said first end being hinged to said platform at a first hinge point;

c) a second bar first end and a second end, and being hinged to said first bar at a second hinge point, displaced from said first hinge point;

d) a third bar, having a first end and a second end, said first end being hinged to said first bar at said second end of said first bar;

e) a fourth bar having a first end and a second end, said first end being hinged to said second bar at said second end of said second bar;

f) said second end of said third bar being hinged to said second end of said forth bar;

g) wherein said spring is connected between said second end of said first bar with said second end of said second bar;

h) a platform pivotably attached to said second ends of said third and fourth bars; and i) wherein expansion of said spring per unit of change in compression of said device, is inversely related to degree of compression of said device.

3. The method of claim 2, wherein said lifting device further includes a parallel set of bars parallel to said first, second, third and fourth bars, hinged together in parallel manner and joined to said first, second, third and fourth bars by a set of cross-members.

4. The method of claim 3, wherein said spring connects said second end of said first bar with said second end of said second bar by connecting a cross-member that is connected to a second end of said first bar to a cross-member that is connected to a second of end of said second bar.

5. The method of claim 1, wherein said end portion is more specifically a corner.

6. The method of claim 1, wherein said end portion is more specifically a mattress-wide end portion.

7. The method of claim 2, wherein said upward force of said device in said compressed state is less than one third of said upward force when said device is half way between its compressed and expanded positions.

8. The method of claim 1, wherein said spring is a coil spring.

9. The method of claim 1, wherein said spring is held in tension, when said device is in its compressed and intermediate states.

* * * * *